United States Patent [19]

Balash et al.

[11] 4,382,165

[45] May 3, 1983

[54] MEMBRANE KEYBOARD AND METHOD OF FORMATION THEREOF

[75] Inventors: Frederick A. Balash; James B. Daugherty, both of Mesa, Ariz.

[73] Assignee: Rogers Corporation, Rogers, Conn.

[21] Appl. No.: 189,119

[22] Filed: Sep. 22, 1980

[51] Int. Cl.[3] ..... H01H 9/00

[52] U.S. Cl. ..... 200/5 A; 29/622; 200/159 B

[58] Field of Search ..... 200/5 A, 159 B, 292; 29/622

[56] References Cited

U.S. PATENT DOCUMENTS

| | | | |
|---|---|---|---|
| 4,017,697 | 4/1977 | Larson | 200/5 A |
| 4,317,013 | 2/1982 | Larson | 200/5 A |
| 4,336,529 | 6/1982 | Buan | 200/5 A |

FOREIGN PATENT DOCUMENTS

| | | |
|---|---|---|
| 1435434 | 5/1976 | United Kingdom . |
| 1512488 | 6/1978 | United Kingdom . |
| 1552639 | 9/1979 | United Kingdom . |
| 2064873 | 6/1981 | United Kingdom . |

*Primary Examiner*—A. T. Grimley
*Assistant Examiner*—Morris Ginsburg
*Attorney, Agent, or Firm*—David S. Fishman

[57] ABSTRACT

A membrane keyboard and method of formation thereof is presented in which the spacing and insulation between fixed and movable circuit layers is achieved by a dielectric material screened or otherwise applied to one of the circuit layers in a predetermined pattern. The dielectric pattern has openings to permit electrical contact between layers, and the dielectric pattern includes a discontinuous pattern of dielectric material on at least one of the contact elements to maintain separation between the contacts while still permitting actuation of the device.

11 Claims, 4 Drawing Figures

MEMBRANE KEYBOARD AND METHOD OF FORMATION THEREOF

BACKGROUND OF THE INVENTION

This invention relates to the field of electrical keyboards. More particularly, this invention relates to the field of membrane keyboards having opposed or facing circuit layers which are separated from each other and have contact areas or elements which may be selectively brought into contact to complete an electrical circuit.

Membrane keyboards of the general type with which this invention is concerned are well known in the art. These keyboards conventionally have a pair of circuit layers, one fixed and one movable, separated by a spacer or separator layer. The circuit layers are sheets of insulating material, typically Mylar, with circuit patterns thereon. These circuit patterns face each other and are separated by a spacer, also typically Mylar, which has apertures at the location of aligned contact elements on the fixed and movable circuit sheets. Electrical switching is effected by applying finger or other pressure to specific locations on one of the circuit sheets to move a contact on that circuit sheet through an aperture to make contact with a contact element on the other circuit sheet. The fixed and movable circuit layers and the spacer may be separate sheets of material, or any two or three of those sheets may be formed from a single sheet of material folded over in any desired fashion. Keyboards of this configuration are generally formed in a laminate construction with the layers bonded together, sealed or otherwise fixed against relative lateral movement between the layers. The assembly may also include an overlay sheet with indicia of one kind or another to identify key locations and a backer plate to support the assembly.

The apertured spacer layer requires the production, handling and assembly or processing of the separate component for each keyboard assembly, and requires the production of a die or other machinery for each spacer design. The apertured spacer element also has a discrete effect on design and operation of the keyboard. Actuating forces and operation of a membrane type keyboard are affected by both the thickness of the spacer element and by the size of the aperture. Furthermore, in applications where very large key areas are desired (e.g., a three inch diameter circular key pad or a three inch by three inch key pad) the apertured spacer becomes unreliable and unacceptable, because the movable circuit layer may sag through the large aperture and come into contact with the lower circuit layer to produce undesirable short circuiting of switch contacts.

SUMMARY OF THE INVENTION

In accordance with the present invention, the apertured spacer layer is eliminated and is replaced with a pattern of nonconductive adhesive on one or both of the circuit layers. The adhesive is applied in a discrete pattern to provide open or uncovered areas at the location of switch contacts. While conventional spacer sheets are typically in the range of from 0.003 inches to 0.005 inches thick and define adequate spacing between the opposed contact elements to prevent undesired short circuiting, a layer of adhesive in accordance with the present invention may be in the range of from only 0.001 to 0.002 inches. Bearing in mind that the contact elements of opposed circuit sheets may project into or sag into the aperture in the adhesive pattern, the spacing of 0.001 to 0.002 inches may not be sufficient to prevent unintended short circuiting of contacts. Therefore, an important feature of the present invention also involves the forming of a discontinuous pattern of insulating adhesive material on one or both of the circuit contacts themselves. This discontinuous pattern serves to maintain the spacing between the contact elements (and hence an open circuit condition) when the keys are in the unactuated state, while permitting areas of the contact elements to be brought together to effect a circuit closure when actuating force is applied to a selected key.

Accordingly, one object of the present invention is to provide a novel and improved membrane switch configuration and method of formation thereof.

Still another object of the present invention is to provide a novel and improved membrane keyboard and method of formation thereof wherein spacing and insulation between circuit layers is effected by an apertured pattern of nonconductive material applied to one or both circuit layers.

Still another object of the present invention is to provide a novel and improved membrane keyboard and method of formation thereof wherein separation and insulation between circuit layers is achieved by a pattern of nonconductive adhesive between the circuit layers, the pattern including a discontinuous pattern of nonconductive material on the conductive contact elements.

Other objects and advantages of the present invention will be apparent to and understood by those skilled in the art from the following detailed description and drawings.

DESCRIPTION OF THE PREFERRED EMBODIMENT

Figure 1:
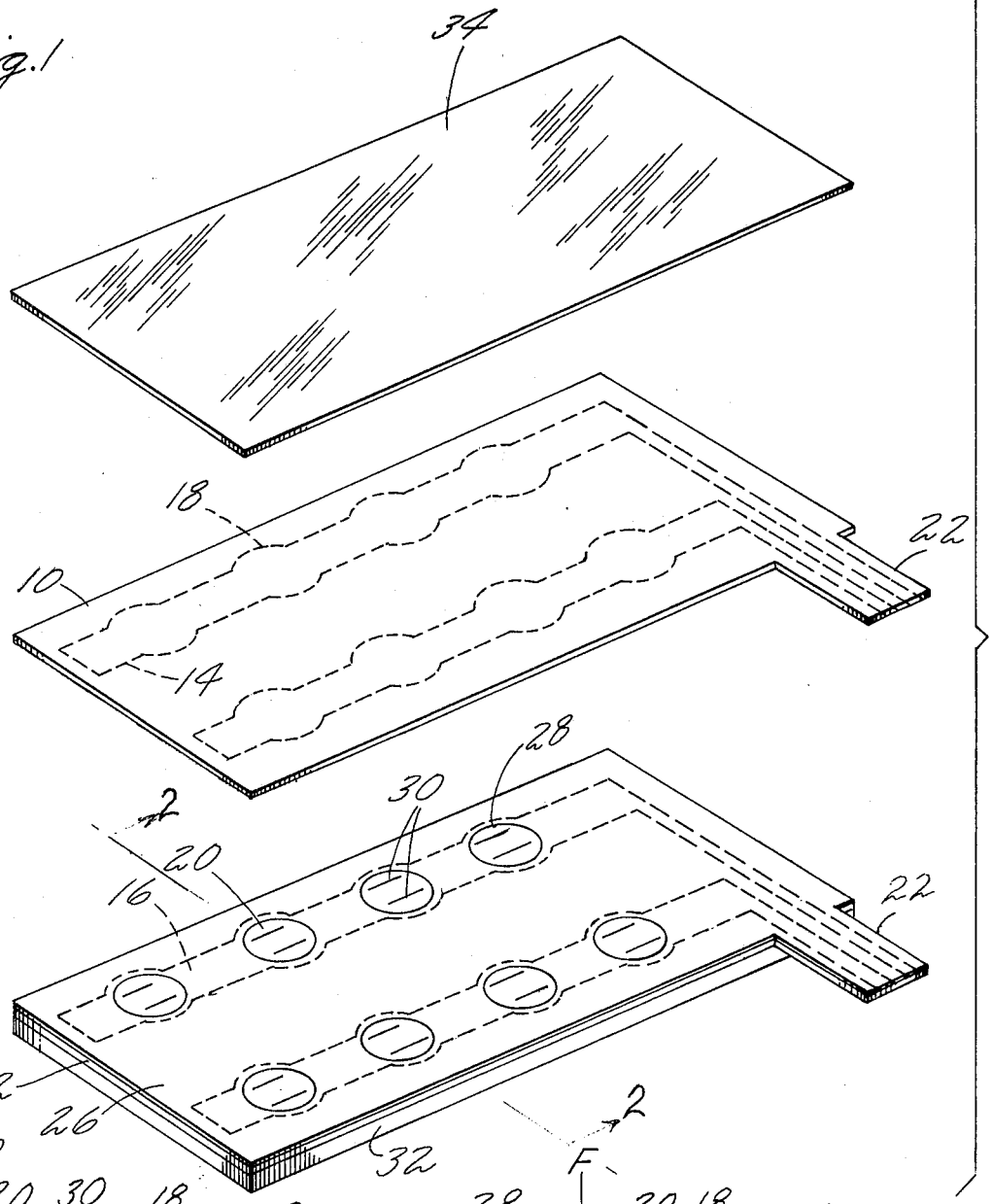
FIG. 1 is an exploded perspective view of a membrane keyboard in accordance with the present invention.
Figure 2:
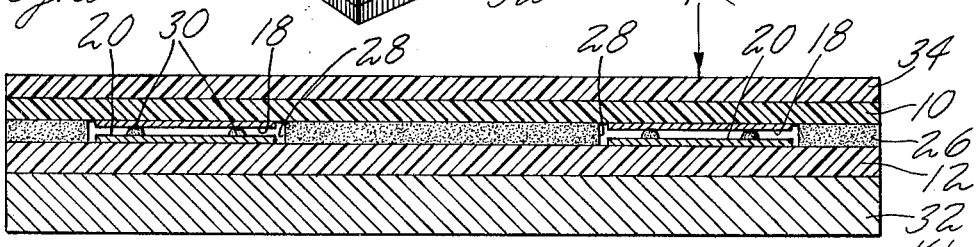
FIG. 2 is a view along line 2—2 of an assembled keyboard of FIG. 1.

Referring first to FIGS. 1 and 2, the membrane switch has a first circuit layer 10 and a second circuit layer 12 having circuit patterns 14 and 16 on opposed, i.e., facing surfaces. For purposes of illustration, the circuit patterns are shown as paths or strips of conductive material with circular contact pads 18 and 20 at each switch location. It will, of course, be understood that the circuit patterns and the contact elements may be of any desired configuration, with the configuration shown in the drawings being only for purposes of illustration. Circuit sheets 10 and 12 are sheets of insulating material, typically a polyester such as Mylar, and the circuit patterns 14 and 16 and contact pads 18 and 20 may be screened conductive ink patterns, etched copper, or other patterns known in the art. The circuit patterns may extend onto tails 22 for external connection of power, logic or other elements to the keyboard.

Circuit layers 10 and 12 are both spaced apart and bonded together by a layer of nonconductive adhesive 26. Adhesive 26 is applied by silk screening or other pattern deposition techniques known in the art so as to form a pattern of apertures or openings 28 at the location of each of the key or switched station defined by the opposed contact pads 18 and 20. Thus, the adhesive layer 26 serves both to bond the circuit elements together and also to define the spacing therebetween.

A most important feature of the present invention is the inclusion of a discontinuous pattern of the nonconductive adhesive 26 in the contact area itself. This nonconductive pattern may be in the form of spaced lines of adhesive 30 or other appropriate line or dot pattern. While the insulating adhesive layer 26 may initially be formed on either one or both of the opposed faces of the circuit sheets 10 and 12, in the final assembly the insulating adhesive layer 26 will be extremely thin (on the order of 0.001 to 0.002 inches). This extreme thinness of the insulating adhesive layer 26 creates the possibility of unintentional and undesirable short circuiting or closing of the current pads 18 or 20, either because of tolerance variations or because of sagging of the unsupported contact areas of circuit sheet 10. Accordingly, the discontinuous nonconductive pattern 30 in each contact area (which may be on either or both of contact elements 20 and 18) serves to keep the contact elements separated during the normal, i.e., unactuated, condition of each switch; while the discontinuous pattern is defined so as to provide adequate spacing to permit contact to be made between contact pads 18 and 20 when an actuating force F is applied to a key station. The discontinuous pattern of insulating material in the contact area may be lines, dots, or any other suitable pattern, so long as it meets the dual requirements of maintaining the contacts spaced apart in the normal, i.e., unactuated condition, while permitting adequate spacing of the pattern elements to permit the contacts to be moved together into conductive contact when a key is actuated.

As shown in FIGS. 1 and 2, the keyboard assembly is completed by the presence of a backer or stiffener board 32 bonded or otherwise secured to the circuit sheet 12, and an optional cover or overlay sheet 34 may be bonded or otherwise secured to the top of sheet 10. Cover sheet 34 typically will contain graphics to identify the various key locations. Backer 32 and cover sheet 34 may be integral parts of a keyboard assembly, or a keyboard may be formed of just the bonded circuit sheets 10 and 12, to which a cover and/or backer may be added when the keyboard is mounted into the apparatus in which it is to be used.

Figure 3:
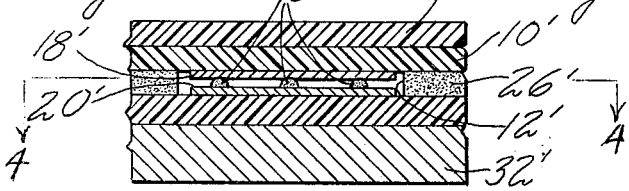
FIG. 3 is a view similar to FIG. 2 showing a single key membrane switch.
Figure 4:
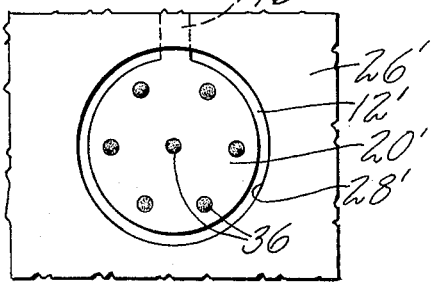
FIG. 4 is a view along line 4—4 of FIG. 3.

Referring now to FIGS. 3 and 4, another embodiment of the present invention in the form of a single key switch is shown, with elements similar to those shown in FIGS. 1 and 2 being marked with prime superscripts. The single key switch shown in FIGS. 3 and 4 is intended to depict a switch having a relatively large contact or key area, such as on the order of a three inch diameter or three inch by three inch key pad. It will be readily apparent that a layer of adhesive 26' of only 0.001 to 0.002 inches thick is inadequate to insure that the large contact pads 18' and 20' will remain spaced apart and separated when switching contact is not desired. Thus, the important feature of the present invention of a discontinuous pattern of insulating material serves to provide the structure by which the key contacts are maintained apart during the normal, i.e., nonoperative, condition of the key. In the configuration shown in FIGS. 3 and 4, the discontinuous insulating pattern in the contact area is a pattern of dots 36 which are distributed over the surface of contact pad 20'. The pattern of dots 36 serves to maintain the desired spacing to prevent contact between pads 18' and 20' when the key is not being actuated. However, the spacing between the dots in the dot pattern is sufficient to provide adequate space whereby pad 18' may be moved into contact with pad 20' to close the switch when a force F is applied to the switch.

The discontinuous pattern of insulating material in the switch contact area, as provided in the present invention, will preferably be the same insulating material as adhesive 26, and it will preferably be deposited in the same screening or other step by which adhesive 26 is deposited to form the adhesive layer and the apertures or openings 28, 28'. However, it is also possible, if desired, to form the discontinuous pattern in the contact areas by a separate step and from different nonconductive material, if such were desired. While the discontinuous pattern in the contact area has been shown and described as lines or dots on one of the contact pads, it will be understood that other discontinuous patterns may be employed, and the discontinuous patterns may be present on both contact pads, rather than just one, as long as adequate space is provided in the discontinuous pattern to permit contact to be effected between the contact pads when switching operation is desired. Also, it is to be understood that the term "discontinuous" is intended to mean that the pattern covers only part of the contact area. Thus, e.g., a single continuous line which weaves back and forth across the contact in a sinuous path would be a discontinuous pattern even though formed from a path connected from end to end. Also, while it is preferred that the insulating material 26 be an adhesive, it may be any nonconductive material that can be screened or otherwise deposited in a desired pattern; and bonding of the assembly may be effected in other ways.

The present invention has numerous advantages: it eliminates the need for design, production, handling and assembly of the conventional spacer component; it eliminates the need for dies or machinery to produce the conventional spacer; it results in a keyboard having a smoother appearance, because of the absence of a conventional spacer which may have a tendency to present an uneven or "bumpy" surface through the cover sheet; it reduces key travel to the range of 0.001" to 0.002" which is indiscernible for all practical purposes; and it achieves increased production speed and reduced cost by making it possible to effect the separation of the circuit sheets by the same technology as is used in defining the circuit paths and by achieving both spacing and bonding of the circuit sheets by the same layer of material.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. An electric switch including:

first electrical contact means;

second electrical contact means;

a layer of electrically nonconductive adhesive material between said first and second contact means, said adhesive layer having an opening therein to permit contact to be effected between said first and second electrical contact means; and a discontinuous pattern of said nonconductive adhesive material on at least one of said first and second electrical contact means within the area defined by said opening.

2. An electrical switch as in claim 1 wherein said first electrical contact means includes:

a layer of flexible insulating material with electrically conductive means on one surface thereof facing said second electrical contact means.

3. An electrical switch as in claim 2 wherein said second electrical contact means includes:

a layer of flexible insulating material with electrically conductive means on one surface thereof facing said first electrical contact means.

4. An electrical switch as in claim 1 wherein:

said discontinuous pattern is effective to normally maintain separation between said first and second contact means while permitting contact therebetween on the application of an actuating force to urge said contact means together.

5. A keyboard including:

first electrical circuit means having a plurality of first switch contacts;

second electrical circuit means having a plurality of second switch contacts corresponding to said first switch contacts;

a layer of electrically nonconductive adhesive material between said first and second electrical circuit means, said adhesive layer being in a pattern having a plurality of openings at locations corresponding to the locations of said first and second switch contacts; and a discontinuous pattern of said nonconductive adhesive material on the switch contacts on at least one of said first and second circuit means within the area defined by said openings.

6. A keyboard as in claim 5 wherein said first electrical circuit means includes:

a layer of flexible insulating material with electrically conductive means on one surface thereof facing said second electrical circuit means.

7. A keyboard as in claim 6 wherein said second electrical circuit means includes:

a layer of flexible insulating material with electrically conductive means on one surface thereof facing said first electrical circuit means.

8. A keyboard as in claim 5 wherein:

said discontinuous pattern is effective to normally maintain separation between said first and second switch contacts while permitting contact therebetween on the application of an actuating force to urge said contacts together.

9. The method of forming a switch configuration, including the steps of:

forming a first generally planar electrical circuit member having at least one switch contact;

forming a second generally planar electrical circuit member having one or more switch contacts corresponding to each switch contact on said first circuit member;

depositing on at least one of said circuit members a layer of electrically nonconductive adhesive material in a pattern having an opening at the location of each corresponding switch contact;

depositing a discontinuous pattern of said electrically nonconductive adhesive material on at least one of each pair of corresponding switch contacts within the area defined by said opening; and assembling said first and second circuit members in a laminate array.

10. The method of claim 9 wherein:

said step of depositing a discontinuous pattern of nonconductive adhesive material on the switch contacts and said step of depositing a layer of nonconductive adhesive material on at least one of the circuit members are performed substantially contemporaneously.

11. The method of claim 10 wherein:

said contemporaneous steps are performed by the same process of deposition of material.

* * * * *